US006955847B1

(12) United States Patent
Itou et al.

(10) Patent No.: US 6,955,847 B1
(45) Date of Patent: Oct. 18, 2005

(54) NONWOVEN FABRIC HAVING ENGAGING FUNCTION

(75) Inventors: Hirosi Itou, Nara-ken (JP); Tadashi Miyazaki, Okayama-ken (JP); Hisashi Nagi, Okayama-ken (JP); Shigekazu Takeuchi, Okayama-ken (JP); Katsumasa Hata, Hyougo-ken (JP)

(73) Assignee: Kuraray Co., Ltd., Kurashiki (JP)

( * ) Notice: Subject to any disclaimer, the term of this patent is extended or adjusted under 35 U.S.C. 154(b) by 351 days.

(21) Appl. No.: 09/787,929

(22) PCT Filed: Aug. 1, 2000

(86) PCT No.: PCT/JP00/05082

§ 371 (c)(1),
(2), (4) Date: May 16, 2001

(87) PCT Pub. No.: WO01/11130

PCT Pub. Date: Feb. 15, 2001

(30) Foreign Application Priority Data

Aug. 3, 1999 (JP) ..... 11/219786

(51) Int. Cl.[7] ..... B32B 1/00; B27N 3/10

(52) U.S. Cl. ..... 428/174; 428/99; 428/175; 264/257; 264/324

(58) Field of Search ..... 428/156, 99, 100, 428/101, 174, 175, 179, 180; 264/257, 285, 248, 319, 324; 156/209

(56) References Cited

U.S. PATENT DOCUMENTS 4,252,590 A * 2/1981 Rasen et al. ..... 156/167
4,631,221 A * 12/1986 Disselbeck et al. ..... 428/166
5,364,686 A * 11/1994 Disselbeck et al. ..... 428/174
5,599,420 A 2/1997 Yeo et al.
5,858,515 A 1/1999 Stokes et al. ..... 428/195

OTHER PUBLICATIONS

Patent Abstracts of Japan, JP 9–003755, Jan. 7, 1997.
Patent Abstracts of Japan, JP 7–034326, Feb. 3, 1995.
Patent Abstracts of Japan, JP 9–262110, Oct. 7, 1997.
Patent Abstracts of Japan, JP 11–285403, Oct. 19, 1999.

* cited by examiner

*Primary Examiner*—Donald J. Loney
(74) *Attorney, Agent, or Firm*—Oblon, Spivak, McClelland, Maier & Neustadt, PC

(57) ABSTRACT

The heat-embossed, fastening non-woven fabric of the present invention comprises, as at least one component, core-sheath or side-by-side heat-fusing composite staple fibers having a low-melting polymer component on a fiber surface, wherein a front surface of the non-woven fabric comprises a non-embossed portion and an embossed portion, the non-embossed portion being a large number of regularly or irregularly dispersed convex island regions upwardly projecting from the front surface, the embossed portion being a sea region surrounding each island region, and at least one end of the composite staple fibers in the non-embossed portion that constitute the convex island regions being press- and heat-anchored at the embossed portion that constitute the sea region. The non-woven fabric of the present invention is thin and flexible, and can be used as a cost-effective loop fastener member suitable for disposable products. In addition, the non-woven fabric of the present invention maintains its high strength because the fibers constituting the loop engaging elements are prevented from being pulled out even if the loop fastener member is subjected to a tensile force from the hook engaging elements.

18 Claims, 1 Drawing Sheet

NONWOVEN FABRIC HAVING ENGAGING FUNCTION

TECHNICAL FIELD

The present invention relates to a non-woven fabric, and more particularly, to an embossed non-woven fabric suitable for a loop fastener member of a surface fastener composed of a hook fastener member and a cooperating loop fastener member.

BACKGROUND ART

Surface fasteners are typically composed of a loop fastener member having loop- or arch-shaped engaging elements provided uprightly on one surface of a base fabric, and a hook fastener member having hook- or mushroom-shaped hook engaging elements provided uprightly on one surface of Another base fabric. By pressing both the engaging elements to each other, the loop and hook fastener members are bound to each other thereby firmly fastening the bodies, each carrying the hook or loop fastener member, into an integral form. With its easy fastening and separating performance, this type of surface fastener has been widely used as a fasteners for opening and closing clothes, shoes, bags, etc., as fasteners for attaching seat covers to seats of automobiles, trains, airplanes, etc., and as fasteners for attaching sheet covers to bedding.

The application field of surface fasteners is expanding to include their application to disposable products such as disposable diapers in particular. In this application field, since the engaging surface area of the loop fastener member is large to decrease production costs, there is an increasing need for a loop fastener member that is inexpensive, good in soft touch, thin, and flexible.

An object of the present invention is, in view of solving the above problems, to provide a non-woven fabric suitable for use as a loop fastener member of disposable products, which is thin, flexible and low in production costs. Another object of the present invention is to provide a non-woven fabric for use as a loop fastener member provided with the loop engaging elements resistant to being pulled out from its base even when subjected to a pulling force by the hook engaging elements, thereby ensuring the mechanical strength of unlimited duration.

DISCLOSURE OF THE INVENTION

In a first aspect of the present invention, there is provided a heat-embossed non-woven fabric comprising as at least one component core-sheath or side-by-side heat-fusing composite staple fibers having a low-melting polymer component on a fiber surface, wherein a front surface of the non-woven fabric comprises a non-embossed portion and an embossed portion, the non-embossed portion being a large number of regularly or irregularly dispersed convex island regions upwardly projecting from the front surface of the non-woven fabric, the embossed portion being a sea region surrounding each island region, and at least one end of the composite staple fibers in the non-embossed portion that constitute the convex island regions being press- and heat-anchored at the embossed portion that constitutes the sea region.

In a preferred embodiment of the present invention:

(1) a basis weight of the non-woven fabric is 20 to 100 g/m$^2$, and a bulk density thereof is 0.01 to 0.10 g/cm$^3$;

(2) 100% of the heat-fusing staple fibers constituting the non-woven fabric are the core-sheath or side-by-side composite staple fibers, the number of crimp of the staple fibers is 10 to 20 crimps/inch, and a percentage crimp is 5 to 20%;

(3) the non-woven fabric is a combined-fiber non-woven fabric wherein the heat-fusing staple fibers constituting the non-woven fabric comprises 100% of the core-sheath or side-by-side composite staple fibers, and contains thin fibers having a single fiber fineness of 1 to 5 denier and thick fibers having a single fiber fineness of 2 to 10 denier;

(4) a height of each convex island region from the surface of the surrounding sea region to its top is 0.3 mm or more;

(5) the base portion of each convex island region has an area corresponding to an area-based equivalent circle having a mean diameter of 2 to 8 mm;

(6) a distance between adjacent island regions is 0.5 to 5.0 mm; and, (7) the number of the island regions is 80 to 800 per 100 cm$^2$ of the non-woven fabric front surface.

In a second aspect of the present invention, there is provided a process of producing a fastening non-woven fabric, comprising heat-embossing a web composed of a sliver of core-sheath or side-by-side heat-fusing composite staple fibers thereby to cause a non-embossed portion to form a large number of regularly or irregularly dispersed convex island regions which are upwardly projected from a front surface of the web and allow an embossed portion to form a sea region surrounding each of the island regions, wherein the dimensions of the non-embossed portion and the embossed portion are adjusted so as to make a maximum diameter of the non-embossed region dispersed as the island regions shorter than a sliver length, and wherein at least one end of the composite staple fibers constituting the non-embossed island regions is heat-anchored at the embossed sea region.

In a third aspect of the present invention, there is provided a loop fastener member for use in a surface fastener, which is made of the non-woven fabric described above.

BEST MODE FOR CARRYING OUT THE INVENTION

The non-woven fabric of the present invention is composed of composite staple fibers having a heat-fusing component on its surface, and produced by heat-embossing a web of the composite staple fibers using a deep embossing roll having projecting parts with large depth so that at least one end of the composite staple fibers in the island regions upwardly projecting from the front surface of the web is allowed to enter into the sea region and heat-anchored there during the heat embossing treatment. So heat-anchored at the sea region, the fibers in the island regions serving as the loop engaging elements are not pulled out even if a peeling force or a tensile force is applied to the loop engaging elements which engage the hook engaging elements, thereby preventing the loop and hook engaging elements from being easily disengaged and providing a satisfactory dimensional stability. Moreover, since the non-woven fabric is produced merely by deep-embossing a bulky web with a small basis weight, it is lightweight, soft in touch, thin, and flexible, and can be produced at low cost. With such advantages, the non-woven fabric is extremely superior as a material for disposable products such as disposable diapers.

Figure 1:
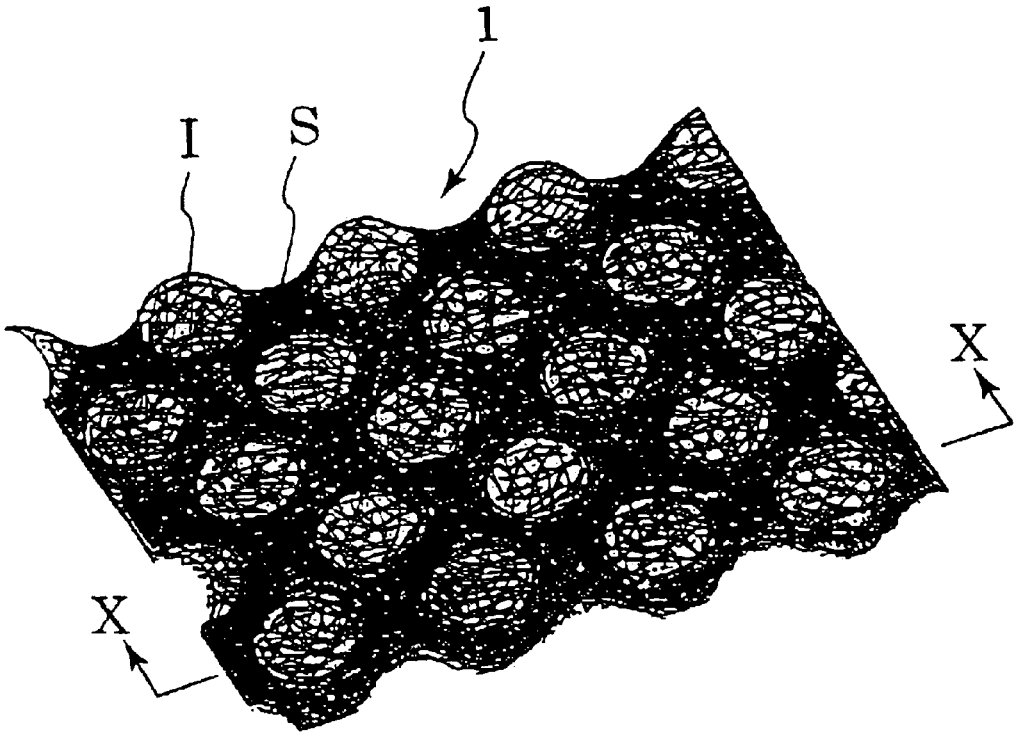
FIG. 1 is a perspective view of a non-woven fabric of the present invention.
Figure 2:
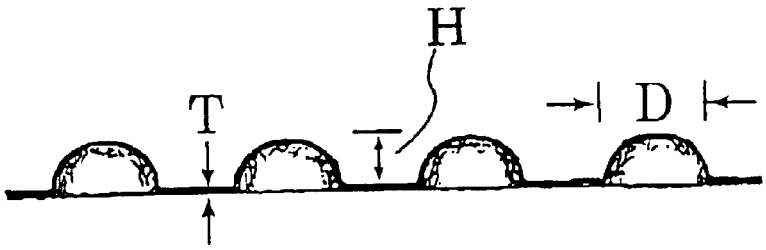
FIG. 2 is a cross-sectional view taken along line X—X of FIG. 1.

FIG. 1 is a perspective view showing a non-woven fabric 1 of the present invention. FIG. 2 is a cross-sectional view taken along line X—X of FIG. 1. As described above, the non-woven fabric 1 of the present invention is produced by heat-embossing a bulky web composed of the core-sheath or side-by-side heat-fusing composite fibers. As shown in FIG. 1, the non-embossed portion forms a large number of regularly or irregularly dispersed convex island regions I which upwardly project from the front surface of the web. The embossed portion forms a sea region S which surrounds each of the large number of island regions I. This structure is obtained by heat-embossing the bulky web between an embossing roller having deep dimples corresponding to the island regions and its counter roller. The maximum diameter D (FIG. 2) of the non-embossed portion forming the dispersed island regions I of the non-woven fabric 1 is adjusted so as to be shorter than the apparent length of the staple fibers in the web, namely, the apparent length of the staple fibers in the web and the maximum diameter of the base portion of the island regions are so controlled that at least one end of the composite staple fibers constituting the island regions I is fusion-bonded to the sea region S by heating.

The fibers that constitute the non-woven fabric of the present invention are required to mechanically strong and heat-fusing such that the fibers in the island regions serving as the loop engaging elements are mutually heat-fused to retain the loop shape, and at least one end of the fibers is heat-anchored at the sea region to prevent the loop-forming fibers from being pulled out even when the fiber is subject to a pulling force. Therefore, the core-sheath or side-by-side type composite fibers comprising a strength-retaining component and a heat-fusing component are used in response to such requirements.

Examples of the combinations of core/sheath polymer components for the heat-fusing composite fibers include polypropylene/polyethylene, polypropylene/modified polypropylene, polyethylene terephthalate/polyamide (nylon), polyethylene terephthalate/polyethylene, polyethylene terephthalate/polypropylene, polyamide (nylon)/polyethylene, and polyamide (nylon)/polypropylene.

The melting point of the core polymer is preferably 150° C. or more in terms of the production and use (processing). A sheath polymer having a melting point of 120° C. or less is not preferable because of a hard feeling after heat-fusing and a low heat resistance during the use (processing).

It is preferable that the polymer components are combined so that the melting point difference between the core polymer and the sheath polymer is 30° C. or more, because the core polymer is prevented from losing its mechanical strength-retaining property during the heat embossing. In addition, it is preferable to combine the core and sheath polymers which have affinity for each other.

Although the above has provided a description on the core-sheath composite fibers, it is clear that the above combinations of the polymer components can also be applied to the side-by-side composite fibers.

In the present invention, 100% use of the heat-fusing compound fibers for constituting the non-woven fabric is preferable in view of the mechanical strength of the loop engaging elements, namely, in view of preventing the fibers from being pulled out or avoiding the destruction of loop shape by a peeling force or a pulling force. However, the 100% use is not critical in the present invention, because such effect can be attained by the use of fibers with another composite structure. The production cost can be reduced by reducing the amount of the heat-fusing composite fibers used, and the content of the heat-fusing composite fibers based on the whole amount of the fibers is sufficiently 80% or more. Examples of usable fibers other than the heat-fusing composite fibers include staple fibers and long fibers with a single fiber fineness of 1 to 10 denier of polypropylene, polyester, polyamide, rayon, vinylon.

The single fiber fineness of the heat-fusing composite fibers is 1 to 10 denier. A single fiber fineness less than 1 denier is not preferable in view of the mechanical strength required for the loop engaging elements, while a single fiber fineness exceeding 10 denier is not preferable with respect to a soft touch and a texture of the non-woven fabric. Furthermore, the non-woven fabric of the present invention may be formed from uniform heat-fusing composite fibers having substantially only one single fiber fineness, or may be formed from mixed heat-fusing composite fibers having different single fiber finenesses within the range of 1 to 10 denier.

The non-woven fabric of the present invention includes a non-woven fabric comprising the heat-fusing composite long fibers, i.e., a span-bonded non-woven fabric, and a non-woven fabric produced by a usual carding process using the heat-fusing composite staple fibers. To obtain a bulky loop fastener member having a large number of minute loops, the latter non-woven fabric using staple fibers is preferably used in the present invention. Furthermore, the length of the staple fibers used in the present invention is preferably 30 to 300 mm, which corresponds to the apparent fiber length of the staple fibers in the web of 15 to 200 mm.

In the non-woven fabric 1 (see FIG. 1) of the present invention, a large number of convex island regions I upwardly extending from the front surface function as the loop engaging elements for engaging with the hook engaging elements. The island regions I correspond to the non-embossed surface in the heat embossing treatment, and are convexly shaped projections which extend from the sea region S and have a base portion of circular, rectangular, rhombic or any other shape. The staple fibers therein are mutually heat-fused at their intersections to form loops for engaging with the hooks.

The sea region S surrounding the island regions I corresponds to the embossed surface in the heat embossing treatment. At least one end of the loop-forming staple fibers constituting the island regions extends to the sea region S, and is anchored there by heat fusing during the heat embossing treatment so as not to be pulled out. In addition, the sea region S plays a major part for retaining the shape of the non-woven fabric.

The island regions I may be arranged regularly or irregularly. Therefore, the sea region S surrounding each island region I is arranged according to the arrangement of the island regions I. The sea region S is not required to be entirely continuous as far as it surrounds each island region I to cause at least one end of the loop-forming staple fibers of the island regions to be heat-anchored in the sea region.

To obtain a non-woven fabric for use as a thin but dimensionally stable loop fastener member having a large number of projections serving as the loop engaging elements, the basis weight of the non-woven fabric is preferably 20 to 100 g/m$^2$. If the basis weight is less than 20 g/m$^2$, the dimensional stability of the base fabric is inadequate (weak tensile resistance) and a thickness of 0.3 mm or more cannot be attained. A basis weight exceeding 100 g/m$^2$ is not preferable because of the detrimental change of appearance of the loop fastener member due to fluffing by repeated fastening and peeling operation, and increased production costs.

The projecting island regions I are required to allow the hook engaging elements to easily penetrate into and easily engage with the loops. To meet this requirement, the non-woven fabric is preferably bulky. It is also required that the non-woven fabric is resistant to the change of shape due to fatigue, interlaminar separation, etc. To satisfy these requirements, the bulk density of the non-woven fabric is preferably 0.01 to 0.10 g/cm$^3$. If the bulk density is less than 0.01 g/cm$^3$, the interlaminar separation frequency occurs. If the bulk density exceeds 0.10 g/cm$^3$, the penetration of the hook engaging elements into the island regions I becomes difficult.

In addition, to obtain a bulky non-woven fabric, the number of crimp of the staple fibers constituting the non-woven fabric is preferably 10 to 20 crimps/inch, and the percentage crimp is preferably 5 to 20%. If the number of crimp is less than 10 crimps/inch and the percentage crimp is less than 5%, the required bulk is not obtained. On the other hand, if the number of crimp exceeds 20 crimps/inch and the percentage crimp exceeds 20%, the engagement between the hook engaging elements and the loop engaging elements is inadequate, and the change of appearance due to fluffing by repeated fastening and peeling operation becomes significant.

Each convex island region I is required to extend from the front surface of the non-woven fabric to reach a sufficient height that facilitates hooking of the hook engaging elements. The height of each island region I, namely, the height H (FIG. 2) from the surface of the sea region S surrounding each island region I to the top of the island region I, is preferably 0.3 mm or more. If the height H is less than 3.0 mm, the hooking of the hook engaging elements is reduced. The height H is preferably 3 mm or less in consideration of the restrictions on production, the height of the hook engaging elements (usually less than 2 mm) and the interlaminar separation.

The convex island regions I correspond to the non-embossed surface in the heat embossing treatment of the non-woven fabric, and extend from the sea region S. The shape of the base portion of the island region, i.e., the shape of the island region as seen from above the non-woven fabric is not limited to a circular shape, and may be any shape so long as the base portion preferably has an mean diameter D of about 2 to 8 mm as calculated from an area-based equivalent circle. If the mean diameter D is less than 2 mm, the effective engaging area cannot be obtained on the upper surface of the island regions I. In addition, if the mean diameter D exceeds 8 mm, both ends of the staple fibers in the upper surface fail to reach the sea region, resulting in an increase in the number of fibers that are heat-anchored in the sea region at only one end. This unfavorably causes the staple fibers in the upper surface to be pulled out by a tensile force from the engaged hook engaging elements, resulting in the destruction of the loops. In addition, the engaging force of the hook engaging elements decreases because of the deformation and shift of the loops. In the present invention, to prevent the staple fibers of the island regions from being pulled out, it is important that the maximum diameter of the base portion of the dispersed projections serving as the island regions be shorter than the apparent length of the staple fibers constituting the web. Namely, it is important to control the size of the island regions and the length of the composite staple fibers constituting the island regions so that at least one end, preferably both ends, of the composite staple fibers be fusion-bonded to the sea region by heating.

As was previously mentioned, the sea region surrounding the island regions is the region where the loop-forming staple fibers of the island regions are anchored to prevent the staple fibers from being pulled out. In this sense, it is enough for the sea region to have an area which allows the staple fibers to be anchored there at its end. Although there are no particular restrictions to the surface area of the sea region, the sea region is preferably formed between adjacent island regions which project at an interval of about 0.5 to 5.0 mm in view of retaining and stabilizing the overall shape of the non-woven fabric.

In summary, it is preferable that 80 to 800 island regions having a mean diameter D of 2 to 8 mm as calculated from an area-based equivalent circle be present per 100 cm$^2$ of the non-woven fabric surface.

The following provides a more detailed explanation of the present invention through its examples. However, it should be noted that the present invention is not limited by these examples. In the examples, the thickness of the non-woven fabrics and surface fastener performance (shear strength and peeling force) were measured by the following methods.

(1) Thickness

The thickness of the non-woven fabric was measured under a load of 12 gf/cm$^2$ by a Dedomatic Indicator 543-454B (available from Teclock, Co., Ltd.).

(2) Shear Strength

A 3 cm×3 cm hook fastener member (product of Velcro Industries B.V.) having about 340 hook-shaped engaging elements of about 0.5 mm high per cm$^2$ was fixed to the end of a film of 3 cm wide×7.5 cm long by a double-coated adhesive tape. Separately, a 5 cm×5 cm loop fastener member prepared in the following example was also fixed to the end of a support plate of 5 cm wide×10 cm long by a double-coated adhesive tape. The respectively prepared hook and loop fastener members were stacked and fastened by rolling back and forth over the stack once with a 700 g roller. Next, the hook fastener member and the loop fastener member were gripped at non-engaged portions at a grip interval of 10 cm using a Model 5543 Instron (Instron Corporation), followed by pulling at a rate of 10 cm/min and reading the breaking shear force. The measurement was made four times, and the average breaking shear force was divided by the engaging area to obtain the shear strength (gf/cm$^2$).

(3) Peeling Force

A hook fastener member and a loop fastener member were prepared in the same manner as in the measurement of the shear strength and fastened. The hook fastener member and the loop fastener member were gripped at the non-engaged portions at a grip interval of 10 cm using a Model 5433 Instron, and then peeled apart at a peel angle of 180° at a rate of 30 cm/min to determine the maximum peeling force. The measurement was carried out four times and the peeling force (gf/cm width) was obtained by dividing the average value of the maximum peeling forces by the sample width (3 cm).

EXAMPLE 1

A card web having a basis weight of 50 g/m$^2$ was prepared from mixed fibers comprising 60 wt % of composite fibers with a single fiber fineness of 2 denier (dr) and 40 wt % of composite fibers with a single fiber fineness of 6 denier (dr), each composite fiber being a core-sheath composite fiber comprising a core polyethylene terephthalate (melting point: 225° C.) and a sheath polyethylene (melting point: 130° C.). The number of crimp and the percentage crimp were 15 crimps/inch and 12% for the 2-dr composite fibers, and 12 crimps/inch and 10% for the 6-dr composite fibers.

An embossing apparatus having an embossing roller and a flat roller was used. The embossing roller was provided with circular recesses of 5 mm in diameter and 2 mm in depth arranged in rows at 5.5 mm intervals so that the circular recesses in one row were in a stagger configuration with those in the next row.

The card web was fed into the embossing apparatus composed of the embossing roller (130° C.) and the flat roller, and heat-embossed at a linear pressure of 30 kgf/cm to obtain an embossed non-woven fabric 1 in which, as shown in FIG. 1, a large number of projecting island regions I corresponding to the non-embossed surface were interspersed in the sea region S corresponding to the embossed surface. The non-woven fabric 1, 1 mm in the height H of island regions I and 0.5 mm in the thickness T of sea region S, was thin, free of deformations in shape, and flexible.

The engaging performance was evaluated using the obtained embossed non-woven fabric as a loop fastener member and a hook fastener member provided with hook-shaped engaging elements having a height of 0.5 mm.

The peeling force was initially 150 gf/cm width and 50 gf/cm width after 10 times engaging and peeling operations. The shear strength was initially 450 gf/cm$^2$, and 200 gf/cm$^2$ after 10 times engaging and peeling operations. The results showed that the obtained non-woven fabric had an engaging performance sufficient for practical use.

EXAMPLE 2

A web having a basis weight of 50 g/cm$^2$ was prepared from core-sheath composite fibers comprising a core polypropylene (melting point: 163° C.) and a sheath polypropylene copolymerized with polyethylene (melting point: 130° C.). The composite fibers were further characterized by the number of crimp of 15 crimps/inch, a percentage crimp of 15% and a single fiber fineness of 2 denier. The web was heat-embossed at 130° C. and a pressure of 30 kgf/cm in the same emboss pattern as in Example 1 to obtain an embossed non-woven fabric in which a large number of projecting island regions corresponding to the non-embossed surface were interspersed in a sea region corresponding to the embossed surface. The non-woven fabric, 0.8 mm in the height H of island regions I and 0.3 mm in the thickness T of sea region S, was thin, free of deformations in shape, and flexible.

The results of the evaluation of the engaging performance showed that the peeling force was initially 180 gf/cm width and 60 gf/cm width after 10 times engaging and peeling operations, and the shear strength was initially 500 gf/cm$^2$ and 220 gf/cm$^2$ after 10 times engaging and peeling operations. The results showed that the obtained non-woven fabric had an engaging performance sufficient for practical use.

EXAMPLE 3

A web having a basis weight of 50 g/cm$^2$ was prepared from core-sheath composite fibers comprising a core polyethylene terephthalate (melting point: 255° C.) and a sheath polyethylene (melting point: 130° C.). The composite fibers were further characterized by the number of crimp of 12 crimps/inch, a percentage crimp of 10% and a single fiber fineness of 6 denier. The web was heat-embossed at 125° C. and a pressure of 30 kgf/cm in the same emboss pattern as in Example 1 to obtain an embossed non-woven fabric in which a large number of projecting island regions corresponding to the non-embossed surface were interspersed in a sea region corresponding to the embossed surface. The non-woven fabric, 1 mm in the height H of island regions I and 0.5 mm in the thickness T of sea region S, was thin, free of deformations in shape, and flexible.

The results of the evaluation of the engaging performance showed that the peeling force was initially 280 gf/cm width and 60 gf/cm width after 10 times engaging and peeling operations, and the shear strength was initially 400 gf/cm$^2$ and 210 gf/cm$^2$ after 10 times engaging and peeling operations. The results showed that the obtained non-woven fabric had an engaging performance sufficient for practical use.

INDUSTRIAL APPLICABILITY

The fastening non woven fabric of the present invention has a good shape stability despite being thin and flexible, and can be produced at low cost.

Therefore, it is extremely superior as a loop fastener member of disposable products such as disposable diapers.

What is claimed is:

1. A heat-embossed, fastening non-woven fabric comprising, as at least one component, core-sheath or side-by-side heat-fusing composite staple fibers of 30 to 300 mm in length having a low-melting polymer component on a fiber surface, a number of crimp of 10 to 20 crimps/inch and a percentage crimp of 5 to 20%, wherein a front surface of the non-woven fabric comprises a non-embossed portion and an embossed portion, the non-embossed portion being a large number of regularly or irregularly dispersed convex island regions upwardly projecting from the front surface of the non-woven fabric, a base portion of each convex island region having an area corresponding to an area-based equivalent circle having a mean diameter of 2 to 8 mm, the embossed portion being a sea region surrounding each island region, and at least one end of the composite staple fibers in the non-embossed portion that constitute the convex island regions being press- and heat-anchored at the embossed portion that constitute the sea region.

2. The non-woven fabric according to claim 1, having a basis weight of 20 to 100 g/m$^2$ and a bulk density of 0.01 to 0.10 g/cm$^3$.

3. The non-woven fabric according to claim 1, wherein 80% of the heat-fusing staple fibers constituting the non-woven fabric are core-sheath or side-by-side composite staple fibers.

4. The non-woven fabric according to claim 1, wherein 100% of the heat-fusing staple fibers constituting the non-woven fabric are core-sheath or side-by-side composite staple fibers.

5. The non-woven fabric according to claim 1, wherein a height of each convex island region from a surface of the sea region surrounding the convex island regions to a top of the convex island regions is 0.3 to 3 mm.

6. The non-woven fabric according to claim 1, wherein a distance between adjacent island regions is 0.5 to 5.0 mm.

7. The non-woven fabric according to claim 1, wherein the number of the island regions is 80 to 800 per 100 cm$^2$ of a surface of the non-woven fabric.

8. A loop fastener member for use in a surface fastener, which is made of the non-woven fabric according to claim 1.

9. The non-woven fabric according to claim 4, comprising core-sheath heat-fusing composite staple fibers.

10. The non-woven fabric according to claim 9, wherein the melting point difference between a core polymer and a sheath polymer is 30° C. or more.

11. The non-woven fabric according to claim 9, comprising a polyethylene terephthalate or polypropylene core and a polyethylene sheath.

12. The non-woven fabric according to claim 10, comprising a polyethylene terephthalate or polypropylene core and a polyethylene sheath.

13. A process of producing a fastening non-woven fabric, comprising forming a web comprising a sliver of core-sheath or side-by-side heat-fusing composite staple fibers of 30 to 300 mm in length, and heat-embossing the web thereby to cause a non-embossed portion to form a number of regularly or irregularly dispersed convex island regions upwardly projected from a front surface of the web and allow an embossed portion to form a sea region surrounding each of the island regions, wherein the dimensions of the non-embossed portion and the embossed portion are adjusted so as to make a maximum diameter of the non-embossed region dispersed as the island regions shorter than a sliver length, and wherein at least one end of the composite staple fibers constituting the non-embossed island regions is heat-anchored at the embossed sea region.

14. The process according to claim 13, wherein said web comprises a sliver of core-sheath heat-fusing composite staple fibers.

15. The process according to claim 14, wherein the melting point difference between the core polymer and the sheath polymer is 30° C. or more.

16. The process according to claim 14, wherein said core-sheath heat-fusing composite staple fibers a comprise a polyethylene terephthalate or polypropylene core and a polyethylene sheath.

17. The process according to claim 15, wherein said core-sheath heat-fusing composite staple fibers a comprise a polyethylene terephthalate or polypropylene core and a polyethylene sheath.

18. The process according to claim 13, wherein said web comprises a sliver of side-by-side heat-fusing composite staple fibers.

* * * * *